US010876397B2

(12) United States Patent
Yang et al.

(10) Patent No.: US 10,876,397 B2
(45) Date of Patent: Dec. 29, 2020

(54) EXPERIMENTAL DEVICE FOR SIMULATING INVASION OF SHALLOW FLUID INTO WELLBORE

(71) Applicant: China University of Petroleum—Beijing, Beijing (CN)

(72) Inventors: Jin Yang, Beijing (CN); Qishuai Yin, Beijing (CN); Shanshan Shi, Beijing (CN)

(73) Assignee: China University of Petroleum-Beijing, Beijing (CN)

( * ) Notice: Subject to any disclaimer, the term of this patent is extended or adjusted under 35 U.S.C. 154(b) by 0 days.

(21) Appl. No.: 16/423,550

(22) Filed: May 28, 2019

(65) Prior Publication Data

US 2020/0056477 A1 Feb. 20, 2020

(30) Foreign Application Priority Data

Aug. 15, 2018 (CN) ..... 2018 1 0927441

(51) Int. Cl.
*E21B 21/00* (2006.01)
*E21B 21/01* (2006.01)
(Continued)

(52) U.S. Cl.
CPC ..... *E21B 49/001* (2013.01); *E21B 21/08* (2013.01); *E21B 21/001* (2013.01); *E21B 21/01* (2013.01);
(Continued)

(58) Field of Classification Search
CPC ..... E21B 21/001; E21B 21/01; E21B 21/08; E21B 21/085; E21B 47/06; E21B 49/001; E21B 49/005
See application file for complete search history.

(56) References Cited

U.S. PATENT DOCUMENTS 3,815,673 A * 6/1974 Bruce ..... E21B 7/128 166/359
6,578,637 B1 * 6/2003 Maus ..... E21B 17/01 166/350
(Continued)

FOREIGN PATENT DOCUMENTS

CN 102086764 A 6/2011
CN 102748015 A 10/2012
(Continued)

OTHER PUBLICATIONS

Simulation and discussion of wellbore pressure in deep water dynamic kill drilling, Chemical management, No. 1,2018,pp. 185-186.
(Continued)

*Primary Examiner* — Matthew R Buck
(74) *Attorney, Agent, or Firm* — Young Basile Hanlon & MacFarlane, P.C.

(57) ABSTRACT

The present invention provides an experimental device for simulating invasion of shallow fluid into a wellbore, comprising: a casing pipe; a drilling-in device including a drill string extending into the casing pipe, and a drill bit located within the casing pipe and connected to the drill string; a driving device for driving rotation of the drill string, the driving device being disposed outside the casing pipe and connected to the drill string; a drilling fluid injection device for injecting drilling fluid into the drill string, the drilling fluid injection device being disposed outside the casing pipe and connected to the drill string; a shallow fluid injection device for injecting shallow fluids into the casing pipe, the shallow fluid injection device being disposed outside the casing pipe and communicating with the casing pipe; a pressure detection device for detecting a pressure within the
(Continued)

casing pipe, the pressure detection device being connected to the casing pipe.

9 Claims, 2 Drawing Sheets

(51) Int. Cl.
*E21B 21/08* (2006.01)
*E21B 47/06* (2012.01)
*E21B 49/00* (2006.01)

(52) U.S. Cl.
CPC ..... *E21B 21/085* (2020.05); *E21B 47/06* (2013.01); *E21B 49/005* (2013.01)

(56) References Cited

U.S. PATENT DOCUMENTS 6,745,857 B2 * 6/2004 Gjedebo ..... E21B 21/001 166/358
8,833,488 B2 * 9/2014 Knudsen ..... E21B 21/08 175/25
2008/0210470 A1 9/2008 Stewart
2011/0100710 A1 * 5/2011 Fossli ..... E21B 33/06 175/7
2016/0357888 A1 * 12/2016 Li ..... E21B 43/34
2019/0145198 A1 * 5/2019 Fossli ..... E21B 21/08 166/335
2019/0145202 A1 * 5/2019 Vavik ..... E21B 21/08 175/25

FOREIGN PATENT DOCUMENTS

CN 103075147 A 5/2013
CN 104074511 A 10/2014
CN 104372105 A 2/2015
CN 105464645 A 4/2016
CN 106522933 A 3/2017
CN 106814166 A 6/2017

OTHER PUBLICATIONS

Simulation on wellbore pressure during dynamic kill drilling in deep water, Acta Petrolei Sinica, vol. 36, No. 2, 2015, pp. 232-236.
Special PCT Search Report, dated Jan. 23, 2019.

* cited by examiner

EXPERIMENTAL DEVICE FOR SIMULATING INVASION OF SHALLOW FLUID INTO WELLBORE

TECHNICAL FIELD

The invention relates to the technical field of offshore shallow drilling, in particular to an experimental device for simulating invasion of shallow fluid into a wellbore.

BACKGROUND

With further development of offshore oil and gas resources, the key areas of oil and gas exploration and development have gradually shifted from an offshore shallow area to a far-sea and deep-water area. On the one hand, shallow geological hazard fluids such as shallow water, shallow gas and the like often exist about 400 meters below mudline in the far-sea and deep-water area. During surface drilling, shallow flows usually flood into the wellbore after drilling because of higher pressure than that in the wellbore, resulting in complex change of pressure within the wellbore. On the other hand, because of deep water depth and poor compaction of shallow seabed soil in a marine deepwater area, fracture pressure of shallow soil is low and a safety pressure window is small. In order to ensure safety and high efficiency of shallow drilling in the deepwater area, a dual-gradient or multi-gradient drilling technique is often used during offshore deepwater drill to ensure that fluid column pressure within the wellbore does not cause leakage of an upper weak formation while balancing the formation pressure of each lay, however, the dual-gradient or multi-gradient drilling technique is often affected by complex pressure conditions within the wellbore.

In order to find out change law of the pressure within the wellbore when shallow geological hazard is drilled, and to reveal a migration mechanism of hazard fluid within the wellbore, and meanwhile to provide a hydraulic foundation for the multi-gradient drilling technology, it is urgent to develop a set of economical, effective and convenient experimental devices to truly simulate the pressure change within the wellbore when the shallow geological hazard is drilled under on-site drilling conditions, so as to provide theoretical guidance for high-efficiency and safe operation on site, and to provide a theoretical basis for follow-up development of high-efficiency offshore deepwater drilling technology.

SUMMARY

An object of the present invention is to provide an experimental device for simulating invasion of shallow fluid into a wellbore, which can truly simulate a working condition that a shallow geological hazard is drilled under on-site drilling conditions, and can monitor the pressure change inside the wellbore when the shallow geological hazard fluids invade.

To achieve the above object, the present invention provides an experimental device for simulating invasion of shallow fluid into a wellbore, comprising: a casing pipe; a drilling-in device including a drill string extending into the casing pipe, and a drill bit located within the casing pipe and connected to the drill string; a driving device for driving rotation of the drill string, the driving device being disposed outside the casing pipe and connected to the drill string; a drilling fluid injection device for injecting drilling fluid into the drill string, the drilling fluid injection device being disposed outside the casing pipe and connected to the drill string; a shallow fluid injection device for injecting shallow fluids into the casing pipe, the shallow fluid injection device being disposed outside the casing pipe and communicating with the casing pipe; and a pressure detection device for detecting a pressure within the casing pipe, the pressure detection device being connected to the casing pipe.

The experimental device for simulating invasion of shallow fluid into a wellbore that is provided by the present invention has the following features and advantages:

1. The experimental device for simulating invasion of shallow fluid into a wellbore according to the present invention is adopted to start the drilling-in device, to inject the drilling fluid into the casing pipe by the drilling fluid injection device, and to inject the shallow fluid into the casing pipe by the shallow fluid injection device, which can truly simulate a working condition that a shallow geological hazard is drilled under on-site drilling conditions, and can also monitor the pressure change inside the wellbore when the shallow geological hazard fluids invade by setting the pressure detection device;
2. In the experimental device for simulating invasion of shallow fluid into a wellbore according to the present invention, circulation of the drilling fluid can be realized by setting a drilling fluid return device, and the drilling-in device, the drilling fluid injection device and the drilling fluid returning device are simultaneously started during experiment, to be able to simulate the working conditions of mud circulation in the case that the drill string rotates; the drilling-in device is closed, and the drilling fluid injection device and the drilling fluid return device are started to be able to simulate the mud circulation in the case that the drill string does not rotate, thereby studying the pressure change within the wellbore caused by invasion of the hazard fluid under the two different conditions;
3. The experimental device for simulating invasion of shallow fluid into a wellbore according to the present invention has a simple structure, and has no specific requirements on an experimental site, can be placed above the ground, and is simple and convenient to operate.

BRIEF DESCRIPTION OF DRAWINGS

The following drawings are intended only to schematically illustrate and explain the invention and do not limit the scope of the invention. In the drawings.

DETAILED DESCRIPTION OF THE EMBODIMENTS

For a clearer understanding of the technical features, objects and effects of the present invention, specific embodiments of the present invention will now be described with reference to the accompanying drawings.

Figure 1:
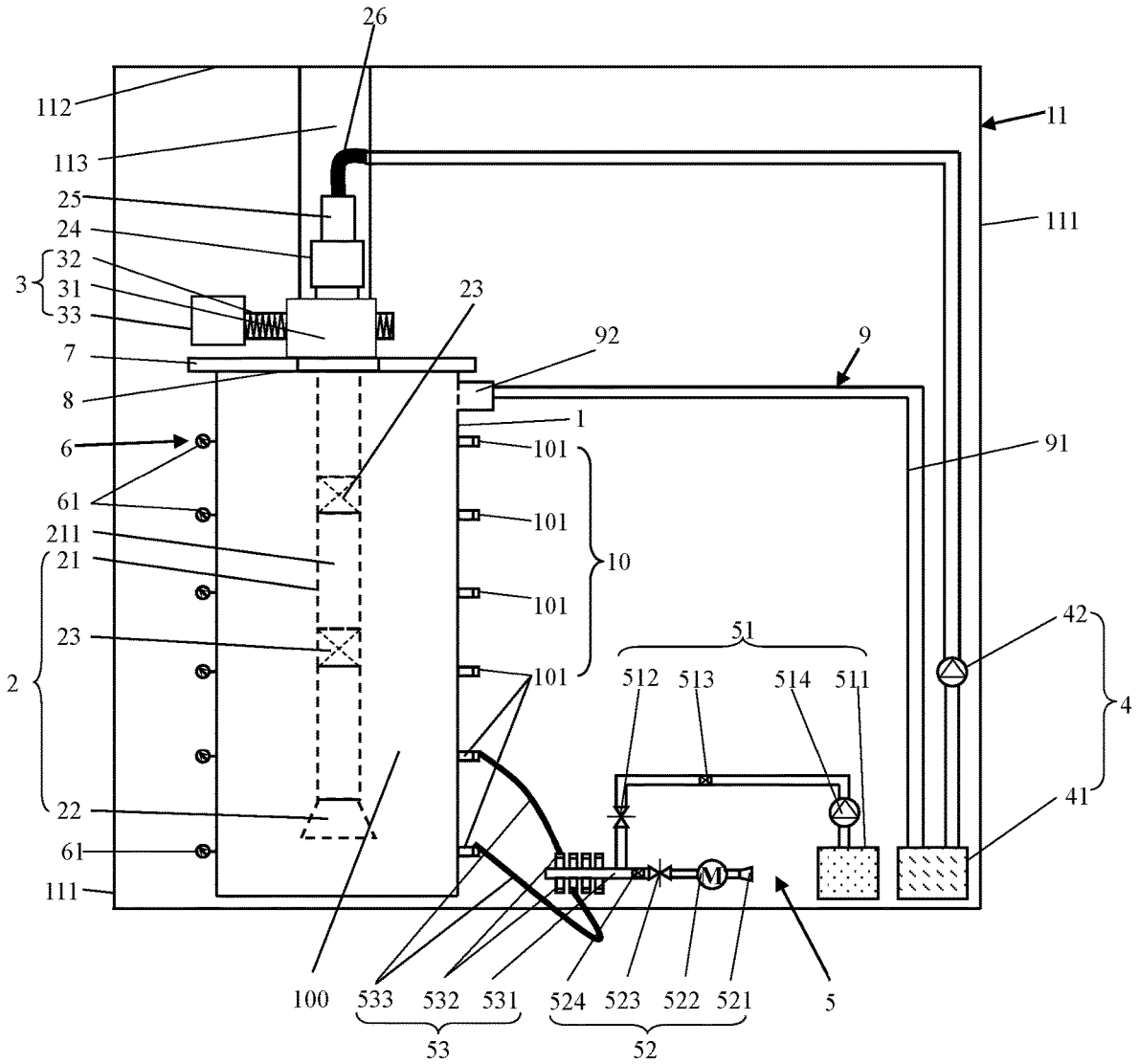
FIG. 1 is a schematic diagram of an experimental device for simulating invasion of shallow fluid into a wellbore according to the present invention.

As shown in FIG. 1, the present invention provides an experimental device for simulating invasion of shallow fluid into a wellbore, comprising a casing pipe 1, a drilling-in device 2, a drive device 3, a drilling fluid injection device 4, a shallow fluid injection device 5, and a pressure detection device 6, wherein casing pipe 1 is used to simulate a wellbore;

the drilling-in device 2 includes a drill string 21 extending into the casing pipe 1, and a drill bit 22 located within the casing pipe 1 and connected to the drill string 21, the drill string 21 having therein a drilling fluid flow channel 211 through which the drilling fluid flows; the driving device 3 is disposed outside the casing pipe 1 and is connected to the drill string 21 for driving the drill string 21 to rotate;

the drilling fluid injection device 4 is disposed outside the casing pipe 1 and is connected to the drill string 21, and the drilling fluid injection device 4 is used to inject drilling fluid (or mud) into the drill string 21, the drilling fluid is for example clean water and enters the inside of the casing pipe 1 via the drill string 21 and the drill bit 22 and can be circulated from a lower end of the casing pipe 1 through an annular space 100 between the drill string 21 and the casing pipe 1 to return upwardly to an upper end of the casing pipe 1;

the shallow fluid injection device 5 is disposed outside the casing pipe 1 and communicates with the casing pipe 1, and the shallow fluid injection device 5 is used for injecting shallow fluid (i.e., hazard fluid) into the casing pipe 1, and the shallow fluid is shallow gas or shallow water;

a pressure detection device 6 is connected to the casing pipe 1, for detecting pressure within the casing pipe 1.

When the experimental device for simulating invasion of shallow fluid into a wellbore according to the present invention is adopted for performing experiment, the drilling-in device 2 is started, to inject the drilling fluid into the casing pipe 1 by the drilling fluid injection device 4, and to inject the shallow fluid into the casing pipe 1 by the shallow fluid injection device 5, which can truly simulate a working condition that a shallow geological hazard is drilled under drilling conditions, and can also monitor the pressure change inside the wellbore when the shallow geological hazard fluids invade by setting the pressure detection device 6.

Specifically, a bottom end of the casing pipe 1 is closed and a top end thereof has an opening where a housing 7 is disposed in the middle part of which a hole is disposed (not shown). The drill string 21 passes through the hole of the housing 7 and is sealed with the housing 7 by a mechanical seal 8, which can ensures that the drilling fluid within the casing pipe 1 does not leak from between the drill string 21 and the housing 7 while the drill string 21 is rotating.

Figure 2:
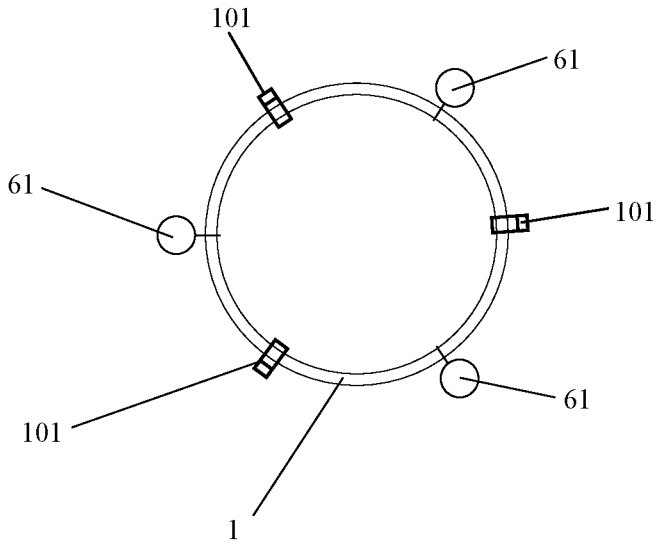
FIG. 2 is a combined schematic diagram of a casing pipe, a second joint, and a pressure sensor assembly in FIG. 1.

As shown in FIGS. 1 and 2, further, the experimental device of the present invention includes multiple groups of pressure detection devices 6 each group including a plurality of pressure sensors 61 connected onto an outer side wall of the casing pipe 1 and arranged at intervals in an axial direction of the casing pipe 1. The multiple groups of pressure detection devices 6 are arranged at intervals in a circumferential direction of the casing pipe 1. By providing multiple groups of pressure detection devices 6, pressure at different positions inside the casing pipe 1 can be detected.

For example, the pressure sensor 61 is a storage type pressure sensor which can continuously record a pressure value at a corresponding position inside the casing pipe 1 and can read pressure data at any time.

Furthermore, the drilling-in device 2 further comprises a first one-way valve 23 located within the casing pipe 1 and connected to the drill string 21, and a drilling faucet 24 located outside the casing pipe 1, wherein the drilling faucet 24 is connected between the drill string 21 and the drilling fluid injection device 4. By providing a first one-way valve 23, one-way flow of the drilling fluid from top to bottom within the drill string 21 can be ensured.

Furthermore, the drilling-in device 2 includes a plurality of drill strings 21 connected in sequence, a drill bit 22 is connected at bottom of the lowermost drill string 21, and a first one-way valve 23 is connected between any two adjacent drill strings 21. For example, the drill bit 22 is threaded with the drill string 21 and can rotate together with the drill string 21, and the first one-way valve 23 is threaded with the drill string 21.

Furthermore, the driving device 3 includes a worm wheel 31, a worm rod 32 and a motor 33, wherein the worm wheel 31 is fixedly connected to the drill string 21, such as an interference fit between the inside of the worm wheel 31 and an outer wall of the drill string 21, the worm rod 32 meshing with the worm wheel 31, the motor 33 is connected to the worm rod 32 and can drive the worm rod 32 to rotate. The worm rod 32 drives the worm wheel 31 meshing therewith to rotate together, and the worm wheel 31 drives the drill string 21 to rotate. However, the present invention is not limited to the above, and the driving device 3 may be a gear-motor-coupled structure.

As shown in FIG. 1, in one specific embodiment, the drilling fluid injection device 4 includes a drilling fluid pool 41 for containing drilling fluid, and a pump 42 connected between the drilling fluid pool 41 and the drilling-in device 2.

Specifically, that pump 42 is connected between the drilling fluid pool 41 and the drilling faucet 24, between the drilling fluid pool 41 and the pump 42, and between the pump 42 and the drilling-in device 2 by pipelines. The pump 42 is threaded with the pipeline and the drilling-in device 2 is threaded with the drilling faucet 24. In order to facilitate connection of the drilling faucet 24, a pipe string 25 may further be connected above the drilling faucet 24, and the pipe string is connected with the pipeline connecting the drilling fluid injection device 4 by a hosepipe 26.

Furthermore, the experimental device further comprises a drilling fluid return device 9 including a liquid return pipe 91, one end of which is connected to and communicates with the casing pipe 1, and the other end of which is connected to the drilling fluid pool 41. The drilling fluid within the casing pipe 1 can return to the inside of the drilling fluid pool 41 through the drilling fluid return device 9.

Specifically, an outlet joint 92 is connected on an upper side wall of the casing pipe 1, the outlet joint 92 communicates with the inside of the casing pipe 1, and a liquid return pipe 91 is connected between the outlet joint 92 and the drilling fluid pool 41. To facilitate the drilling fluid within the casing pipe 1 to return to the drilling fluid pool 41 the action of gravity, the drilling fluid pool 41 is installed below the outlet joint 92, for example, placed on a horizontal surface.

By providing the drilling fluid return device 9, the circulation of the drilling fluid can be realized, i.e., after the pump 92 is started, the drilling fluid in the drilling fluid pool 41 enters an annular space between the drill string 21 and the casing pipe 1, and then returns to the inside of the drilling fluid pool 41 through the liquid return pipe 91 to complete once-through circulation.

During the experiment, the drilling-in device 2, the drilling fluid injecting device 4 and the drilling fluid return device 9 are started simultaneously, to be able to simulate the working conditions of mud circulation in the case that the drill string 21 rotates; the drilling-in device 2 is closed, and the drilling fluid injection device 4 and the drilling fluid return device 9 are started to be able to simulate the mud circulation in the case that the drill string 21 does not rotate, thereby studying the pressure change within the wellbore caused by invasion of the hazard fluid into the wellbore under the two different conditions.

In another specific embodiment, the shallow fluid injection device 5 includes a shallow water injection device 51 and a shallow gas injection device 52. The shallow water injection device 51 includes a water reservoir 511 for containing water, and a first valve 512, a second one-way valve 513 and a water pump 514 that are connected between the water reservoir 511 and the casing pipe 1, for example, the water reservoir 511, the water pump 514, the second one-way valve 513 and the first valve 512 are connected in sequence. The water pump 514 is used for transporting water, water within the water reservoir 511 is pumped by the water pump 514 into the casing pipe 1 via the opened second one-way valve 513 and the first valve 512. The second one-way valve 513 can control one-way flow of water from the water reservoir 511 to the casing pipe 1, and the first valve 512 can open or close the water injection line.

The shallow gas injection device 52 includes a gas inlet slot 521, a gas compressor 522, and a second valve 523 and a third one-way valve 524 that are connected between the gas compressor 522 and the casing pipe 1. The gas inlet slot 521, the gas compressor 522, the second valve 523 and the third one-way valve 524 are sequentially connected. The gas enters from the gas inlet slot 521 through the air in the external atmosphere, and is then compressed into high-pressure gas by the gas compressor 522. The high-pressure gas then enters the casing pipe 1 through the opened second valve 523 and the third one-way valve 524 which controls the one-way flow of gas from the gas compressor 522 to the casing pipe 1, and the second valve 523 can open or close the gas injection line.

Furthermore, the shallow fluid injection device 5 further includes a gas-liquid input device 53 including an input pipeline 531, a plurality of first joints 532 connected on the input pipeline 531, and at least one high-pressure hosepipe 533. The inlet pipeline 531 is connected to the shallow water injection device 51 and the shallow gas injection device 52. One end of each high-pressure hosepipe 533 can be connected to the first joint 532, and the other end thereof can be connected to and communicates with the casing pipe 1. When injecting the shallow gas and/or the shallow water, both ends of the high-pressure hosepipe 533 are connected to the first joint 532 of the gas-liquid input device 53 and the casing pipe 1, respectively. The shallow gas and/or the shallow water flows into the inside of the casing pipe 1 via the gas-liquid input device 53 and the high-pressure hosepipe 533.

Specifically, one end of the input pipeline 531 is connected to both of a pipeline of the shallow water injection device 51 and a pipeline of the shallow gas injection device 52.

As shown in FIGS. 1 and 2, furthermore, the experimental device further includes multiple groups of connecting members 10 each group of which includes a plurality of second joints 101 connected on an outer side wall of the casing pipe 1 and arranged at intervals in the axial direction of the casing pipe 1. The multiple groups of connecting members 10 are arranged at intervals in the circumferential direction of the casing pipe 1, and each of the second joints 101 can be connected to the shallow fluid injection device 5, that is, to the gas-liquid input device 53. Specifically, in the experiment, one end of the high-pressure hosepipe 533 is connected to the second joint 101 of the casing pipe 1, and the other end of the high-pressure hosepipe 533 is connected to the first joint 532 of the gas-liquid input device 53.

For example, there are three groups of connecting members 10, and three groups of pressure detection devices 6. In the circumferential direction of the casing pipe 1, the connecting members 10 and the pressure detection devices 6 are alternately arranged at 60 degree angular intervals.

Furthermore, the first joint 532 and the second joint 101 are both quick joints, and when being not connected to the high-pressure hosepipe 533, the quick joints can block outflow of the fluid, and when being connected to the high-pressure hosepipe 533, the quick joints can communicate the pipeline. Quick joints may also be connected at both ends of the high-pressure hosepipe 533 to facilitate quick connection of the high-pressure hosepipe 533 with the casing pipe 1 and the gas-liquid input device 53.

The embodiment is provided with multiple groups of connecting members 10 capable of simulating different depths of shallow fluid invasion by connecting the shallow fluid injection device 5 to second joints 101 at different depths on the outer wall of the casing pipe 1. For example, by connecting the second joint 101 at the depth of the drill bit 22, it is possible to simulate that the drill bit 22 has just drilled the shallow fluid at a drill-in place, and by connecting the second joint 101 above the drill bit 22, it is possible to simulate that the drill bit 22 encounters the shallow fluid after drilling. By simultaneously connecting the second joints 101 at and above the depth of the drill bit 22, it is possible to simulate the simultaneous occurrence of shallow fluid invasion at the drilling depth and the post-drilling depth.

In addition, by connecting the shallow fluid injection device 5 to the second joints 101 at different positions in the circumferential direction of the outer wall of the casing pipe 1, it is possible to simulate invasion of the shallow fluid from different orientations, and by connecting the shallow fluid injection device 5 to different numbers of the second joints 101, it is possible to stimulate different invasion amounts of the shallow fluid.

In the embodiment as shown in FIG. 1, the experimental device of the present invention further includes a bracket 11 including four pillars 111, a steel plate 112, and a stud 113. The four pillars 111 are arranged in a square shape. The steel plate 112 is disposed at top ends of the four pillars 112. The casing pipe 1, the drilling-in device 2, the driving device 3, the drilling fluid injection device 4, the shallow fluid injection device 5 and the pressure detection device 6 are all disposed inside the four pillars 111 and are under the steel plate 112, wherein the water reservoir 511 may also be placed on the steel plate 112 so that water flows into the inside of the casing pipe 1 under the action of gravity. The steel plate 112 and the driving device 3 are connected by four studs 113, to suspend and fix the driving device 3 under the steel plate 112, however, the present invention is not limited to the above, and the driving device 3 may be fixed in other ways.

Furthermore, the present invention also includes a pulley (not shown) connected at the bottom of the bracket 11 to facilitate the transfer of the experimental device.

The experimental device for simulating invasion of shallow fluid into a wellbore according to the present invention is used by a method including:

1. Operation steps for simulating a working condition that hazard fluid invades under the condition that the drill string 21 rotates and mud circulates:

(1) checking the sealing performance of each connection;

(2) starting the driving device 3 to cause the drill string 21 to start slow rotation;

(3) starting the pump 42 to cause the mud in the drilling fluid pool 41 to flow to the inside of the drill string 21 and the casing pipe 1 at a certain flow rate, and to establish circulation of the mud, so as to simulate the mud circulation under the rotation of the drill string 21;

(4) connecting the high-pressure hosepipe 533 between the first joint 532 and the second joint 101, opening the first valve 512 of the shallow water injection device 51 and/or the second valve 523 of the shallow gas injection device 52. The shallow water and/or the shallow gas are injected into the casing pipe 1 through the gas-liquid input device 53, so as to simulate a working condition that hazard fluid invades under the condition of mud circulation.

2. Operation steps for simulating a working condition that hazard fluid invades under the condition that the drill string 21 does not rotate and mud circulates:

(1) checking the sealing performance of each connection;

(2) starting the pump 42 to cause the mud in the drilling fluid pool 41 to flow to the inside of the drill string 21 and the casing pipe 1 at a certain flow rate, so as to simulate the working condition of the mud circulation in the case that the drill string 21 does not rotate;

(3) connecting the high-pressure hosepipe 533 between the first joint 532 and the second joint 101, opening the first valve 512 of the shallow water injection device 51 and/or the second valve 523 of the shallow gas injection device 52. The shallow water and/or the shallow gas are injected into the casing pipe 1 through the gas-liquid input device 53, so as to simulate a working condition that hazard fluid invades under the condition of mud circulation and that the drill string 21 does not rotate.

3. Simulation of Depth of Shallow Fluid Invasion

In the step (4) of simulating the mud circulation condition in the case of rotation of the drill string 21 and the step (3) of simulating the mud circulation condition in the case of no rotation of the drill string 21, by connecting the high-pressure hosepipe 533 to the second joints 101 at different depths on the outer wall of the casing pipe 1, it is possible to simulate the depth of invasion of the shallow fluid. For example, by connecting the second joint 101 at the same depth as the drill bit 22, it is possible to stimulate that the shallow fluid is just drilled; and by connecting the second joint 101 at a position above the drill bit 22, it is possible to stimulate shallow fluid invasion encountered after drilling; and by simultaneously connecting the second joints 101 at the same depth as the drill bit 22 and at a position above the drill bit 22, it is possible to stimulate simultaneous occurrence of shallow fluid invasion at the drilling depth and the post-drilling depth.

4. Simulation of Orientation and Flow Rate of Shallow Fluid Invasion

The orientation and the amount of invasion of the shallow fluid are simulated by connecting different numbers of second joints 101: when three second joints 101 are uniformly arranged at intervals of 120 degrees in a horizontal circumferential direction of the same depth, different invasion orientations and different invasion amounts of the shallow fluid are stimulated by connecting one, two or three second joints 101.

From the above, it can be seen that the experimental simulation can be performed by changing the experimental conditions using the experimental device of the present invention.

The experimental device for simulating invasion of shallow fluid into a wellbore according to the present invention can accurately control the time and conditions of invasion of shallow geological hazard fluids, can reveal a migration mechanism of the hazard fluids within the wellbore and a rule of pressure change within the wellbore after invasion of the shallow fluids, so as to provide a hydraulic foundation for deep water multi-gradient drilling.

The foregoings are merely illustrative specific embodiments of the invention and are not intended to limit the scope of the invention. Any equivalent changes and modifications made by those skilled in the art without departing from the concepts and principles of the present invention shall fall within the scope of the present invention. It should also be noted that the components of the present invention are not limited to the above-described overall application, and the technical features described in the specification of the present invention can be selected to be used individually or in combination according to actual needs, and therefore, the present invention deservedly encompasses other combinations and specific applications related to the inventive points of the present application.

DESCRIPTION OF MAIN ELEMENT SIGNS

1 casing pipe
2 drilling-in device
21 drill string
22 drill bit
23 first one-way valve
24 drilling faucet
25 pipe string
26 hosepipe
211 drilling fluid flow channel
3 driving device
31 worm wheel
32 worm rod
33 motor
4 drilling fluid injection device
41 drilling fluid pool
42 pump
5 shallow fluid injection device
51 shallow water injection device
511 water reservoir
512 first valve
51 second one-way valve
514 water pump
52 shallow gas injection device
521 gas inlet slot
522 gas compressor
523 second valve
524 third one-way valve
53 gas-liquid input device
531 input pipeline
532 first joint
533 high pressure hosepipe
6 pressure detection device
61 pressure sensor
7 housing
8 mechanical seal
9 drilling fluid return device
91 liquid return pipe
92 outlet joint
10 connector
101 second joint
11 bracket
111 pillar

112 steel plate
113 stud
100 annular space

What is claimed is:

1. An experimental device for simulating invasion of shallow fluid into a wellbore, characterized in that the experimental device comprises:

a casing pipe;

a drilling-in device including a drill string extending into the casing pipe, and a drill bit located within the casing pipe and connected to the drill string;

a driving device configured to drive rotation of the drill string, the driving device being disposed outside the casing pipe and connected to the drill string;

a drilling fluid injection device configured to inject drilling fluid into the drill string, the drilling fluid injection device being disposed outside the casing pipe and connected to the drill string;

a shallow fluid injection device configured to inject shallow fluids into the casing pipe, the shallow fluid injection device being disposed outside the casing pipe and communicating with the casing pipe, and the shallow fluid injection device includes a shallow water injection device and a shallow gas injection device, and the shallow water injection device includes a water reservoir, and a first valve, a second one-way valve and a water pump that are connected between the water reservoir and the casing pipe, and the shallow gas injection device includes a gas compressor, and a second valve and a third one-way valve that are connected between the gas compressor and the casing pipe; and a pressure detection device configured to detect a pressure within the casing pipe, the pressure detection device being connected to the casing pipe.

2. The experimental device for simulating invasion of shallow fluid into a wellbore according to claim 1, wherein the drilling-in device further includes a first one-way valve located within the casing pipe and connected to the drill string, and a drilling faucet located outside the casing pipe, wherein the drilling faucet is connected between the drill string and the drilling fluid injection device.

3. The experimental device for simulating invasion of shallow fluid into a wellbore according to claim 1, wherein the driving device includes:

a worm wheel fixedly connected to the drill string;

a worm rod that meshes with the worm wheel; and a motor connected to the worm rod and capable of driving the worm rod to rotate.

4. The experimental device for simulating invasion of shallow fluid into a wellbore according to claim 1, wherein the drilling fluid injection device includes a drilling fluid pool for containing drilling fluid, and a pump connected between the drilling fluid pool and the drilling-in device.

5. The experimental device for simulating invasion of shallow fluid into a wellbore according to claim 4, wherein the experimental device further comprises a drilling fluid return device including a liquid return pipeline, one end of which is connected to and communicates with the casing pipe, and the other end of which is connected to the drilling fluid pool.

6. The experimental device for simulating invasion of shallow fluid into a wellbore according to claim 1, wherein the shallow fluid injection device further includes a gas-liquid input device including an input pipeline, a plurality of first joints connected on the input pipeline, and at least one high-pressure hosepipe, wherein the inlet pipeline is connected to the shallow water injection device and the shallow gas injection device, one end of the at least one high-pressure hosepipe can be connected to the first joint, and the other end thereof can be connected to and communicates with the casing pipe.

7. The experimental device for simulating invasion of shallow fluid into a wellbore according to claim 1, wherein the experimental device includes multiple groups of the pressure detection device each group including a plurality of pressure sensors connected onto an outer side wall of the casing pipe and arranged at intervals in an axial direction of the casing pipe, wherein the multiple groups of the pressure detection device are arranged at intervals in a circumferential direction of the casing pipe.

8. The experimental device for simulating invasion of shallow fluid into a wellbore according to claim 1, wherein the experimental device further includes multiple groups of connecting members each group of which includes a plurality of second joints connected on an outer side wall of the casing pipe and arranged at intervals in the axial direction of the casing pipe, wherein the multiple groups of connecting members are arranged at intervals in the circumferential direction of the casing pipe, and each of the second joints can be connected to the shallow fluid injection device.

9. The experimental device for simulating invasion of shallow fluid into a wellbore according to claim 8, wherein the second joint is a quick joint.

* * * * *